US008983350B2

(12) United States Patent
Suzuki et al.

(10) Patent No.: US 8,983,350 B2
(45) Date of Patent: Mar. 17, 2015

(54) FIXING DEVICE

(75) Inventors: Noboru Suzuki, Komaki (JP); Yasushi Fujiwara, Itami (JP); Tsuneo Fujiwara, legal representative, Itami (JP); Etsuko Fujiwara, legal representative, Itami (JP); Kei Ishida, Nagoya (JP); Yoshihiro Miyauchi, Ama (JP); Tomohiro Kondo, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 62 days.

(21) Appl. No.: 12/915,180

(22) Filed: Oct. 29, 2010

(65) Prior Publication Data

US 2011/0158717 A1 Jun. 30, 2011

(30) Foreign Application Priority Data

Oct. 30, 2009 (JP) ..... 2009-250238

(51) Int. Cl.
*G03G 15/20* (2006.01)
*H05B 6/14* (2006.01)

(52) U.S. Cl.
CPC ..... *H05B 6/145* (2013.01); *G03G 15/2007* (2013.01); *G03G 2215/2035* (2013.01)
USPC ..... 399/329

(58) Field of Classification Search
USPC ..... 399/122, 328, 239, 335, 338; 219/216, 219/243
See application file for complete search history.

(56) References Cited

U.S. PATENT DOCUMENTS

| | | | |
|---|---|---|---|
| 7,242,896 | B2 | 7/2007 | Haseba et al. |
| 7,386,265 | B2 | 6/2008 | Ito et al. |
| 7,502,585 | B2 | 3/2009 | Uehara et al. |
| 7,548,719 | B2 | 6/2009 | Ito et al. |
| 8,428,498 | B2 | 4/2013 | Fujiwara et al. |
| 2005/0265758 | A1 | 12/2005 | Haseba et al. |
| 2006/0140690 | A1 | 6/2006 | Ito et al. |
| 2006/0177251 | A1 | 8/2006 | Uehara et al. |

(Continued)

FOREIGN PATENT DOCUMENTS

| | | | |
|---|---|---|---|
| JP | H02-021667 | U | 2/1990 |
| JP | 08-248791 | A | 9/1996 |

(Continued)

OTHER PUBLICATIONS

Co-pending U.S. Appl. No. 12/915,173, filed Oct. 29, 2010.
US Office Action dtd Oct. 15, 2012, U.S. Appl. No. 12/915,173.
Final Office Action received in U.S. Appl. No. 12/915,173 mailed Apr. 23, 2013.

(Continued)

*Primary Examiner* — David Gray
*Assistant Examiner* — Thomas Giampaolo, II
(74) *Attorney, Agent, or Firm* — Banner & Witcoff, Ltd.

(57) ABSTRACT

A fixing device for thermally fixing a developing agent image to a sheet fed in a sheet feeding direction includes a tubular flexible fusing member, a nip plate, a heater, a reflection plate, and a backup member. The tubular flexible fusing member has an inner peripheral surface defining an internal space and an axis defining an axial direction. The nip plate is disposed in the internal space, and the inner peripheral surface is in sliding contact with the nip plate. A heater is disposed in the internal space and confronts the nip plate in a confronting direction. The reflection plate is configured to reflect a radiant heat from the heater toward the nip plate. A backup member is configured to provide a nip region in cooperation with the nip plate for nipping the fusing member between the backup member and the nip plate.

52 Claims, 5 Drawing Sheets

(56) References Cited

U.S. PATENT DOCUMENTS

| | | | | |
|---|---|---|---|---|
| 2007/0053730 | A1* | 3/2007 | Uehara et al. | 399/328 |
| 2008/0199231 | A1 | 8/2008 | Lee et al. | |
| 2008/0205949 | A1* | 8/2008 | Ito et al. | 399/330 |
| 2008/0317527 | A1 | 12/2008 | Seol et al. | |
| 2009/0010688 | A1 | 1/2009 | Takahashi et al. | |
| 2009/0208264 | A1 | 8/2009 | Fujiwara et al. | |

FOREIGN PATENT DOCUMENTS

| | | | |
|---|---|---|---|
| JP | 2003-045377 | A | 2/2003 |
| JP | 2005-338724 | A | 12/2005 |
| JP | 2006-047769 | | 2/2006 |
| JP | 2006-047769 | A | 2/2006 |
| JP | 2006-184719 | A | 7/2006 |
| JP | 2006-220950 | A | 8/2006 |
| JP | 2008-233886 | A | 10/2008 |
| JP | 2008-292585 | A | 12/2008 |
| JP | 2008-292586 | A | 12/2008 |

OTHER PUBLICATIONS

JP Office Action mailed Apr. 23, 2013, JP Appln. 2009-250235, English translation.

JP Office Action mailed Apr. 23, 2013, JPApp 2009-250238, English translation.

JP Office Action mailed Sep. 3, 2013, JP Appln. 2013-130287, English Translation.

JP Office Action mailed Sep. 3, 2013, JP Appln. 2013-130288, English Translation.

Non Final Office Action issued in U.S. Appl. No. 12/915,173, mailed Oct. 30, 2013.

Decision of Rejection mailed Dec. 3, 2013, JP Appln. 2013-130287, English Translation.

Sep. 8, 2014—(US) Notice of Allowance—U.S. Appl. No. 12/915,173.

Final Office Action received in corresponding U.S. Appl. No. 12/915,173 mailed May 22, 2014.

Nov. 25, 2014—(JP) Office Action—App 2013-130287—Eng Tran.

Jan. 6, 2015—(JP) Office Action—App 2014-040253, Eng Tran.

* cited by examiner

FIXING DEVICE

CROSS REFERENCE TO RELATED APPLICATION

This application claims priority from Japanese Patent Application No. 2009-250238 filed Oct. 30, 2009. The entire content of the priority application is incorporated herein by reference. The present application closely relates to a co-pending US patent application (based on Japanese patent application No. 2009-250235 filed Oct. 30, 2009) which is incorporated by reference.

TECHNICAL FIELD

The present invention relates to a fixing device that thermally fixes a transferred developing agent image to a sheet.

BACKGROUND

A conventional fixing device includes a fusing film, a heater, a pressure roller, a heating plate (nip plate) defining a nip portion relative to the pressure roller through the fusing film, and a reflection plate for reflecting radiant heat from the heater to the nip plate.

SUMMARY

The heater such as a halogen heater includes a glass tube body in which a heat source and a gas are sealingly disposed. For the gas sealing, a tip portion protrudes radially outwardly from the glass tube body. The inventors of the present application found that the orientation of the tip portion is one of important factors for the fusing performance and size of the fixing device, since the orientation may have an impact on positions and size of the reflection plate and the nip plate. In view of the foregoing, it is an object of the invention to provide a compact fixing device capable of improving fusing performance.

In order to attain the above and other objects, the present invention provides a fixing device for thermally fixing a developing agent image to a sheet fed in a sheet feeding direction including: a tubular flexible fusing member; a nip plate; a heater; a reflection plate; and a backup member. The tubular flexible fusing member has an inner peripheral surface defining an internal space and an axis defining an axial direction. The nip plate is disposed in the internal space. The inner peripheral surface is in sliding contact with the nip plate. The heater is disposed in the internal space and confronts the nip plate in a confronting direction. The heater includes a glass tube, a heat source provided in the glass tube, and a gas sealed in the glass tube. The glass tube includes a glass tube body and a tip portion protruding radially outwardly from the glass tube body for sealing the gas in the glass tube body. The tip portion protrudes in a predetermined direction to define a cross-sectional length of the glass tube in the confronting direction smaller than a cross-sectional length of the glass tube in a perpendicular direction extending perpendicular to the confronting direction and the axial direction, and the cross-section includes the tip portion. The reflection plate is configured to reflect a radiant heat from the heater toward the nip plate. The backup member is configured to provide a nip region in cooperation with the nip plate for nipping the fusing member between the backup member and the nip plate.

According to another aspect, the present invention provides a fixing device for thermally fixing a developing agent image to a sheet fed in a sheet feeding direction including: a tubular fusing film; a nip member; and a heater. The tubular fusing film has an inner peripheral surface defining an internal space and an axis defining an axial direction. The nip member is disposed in the internal space. The inner peripheral surface is in sliding contact with the nip member. The heater is disposed in the internal space and confronts the nip member in a confronting direction. The heater includes a heating body and a projection protruding outwardly from the heating body in a perpendicular direction extending perpendicular to the confronting direction and the axial direction. The heater has a first length in the confronting direction and a second length in the perpendicular direction. The first length is smaller than the second length.

According to still another aspect, the present invention provides a fixing device for thermally fixing a developing agent image to a sheet fed in a sheet feeding direction including: a tubular fusing film; a nip member; and a heater. The tubular fusing film has an inner peripheral surface defining an internal space and an axis defining an axial direction. The nip member is disposed in the internal space. The inner peripheral surface is in sliding contact with the nip member. The heater is disposed in the internal space and confronts the nip member in a confronting direction. The heater includes a glass tube, a heat source provided in the glass tube, and a gas sealed in the glass tube. The glass tube includes a glass tube body and a tip portion protruding radially outwardly from the glass tube body for sealing the gas in the glass tube body. The heater has a first length in the confronting direction and a second length in a perpendicular direction extending perpendicular to the confronting direction and the axial direction. The first length is smaller than the second length.

DETAILED DESCRIPTION

Figure 1:
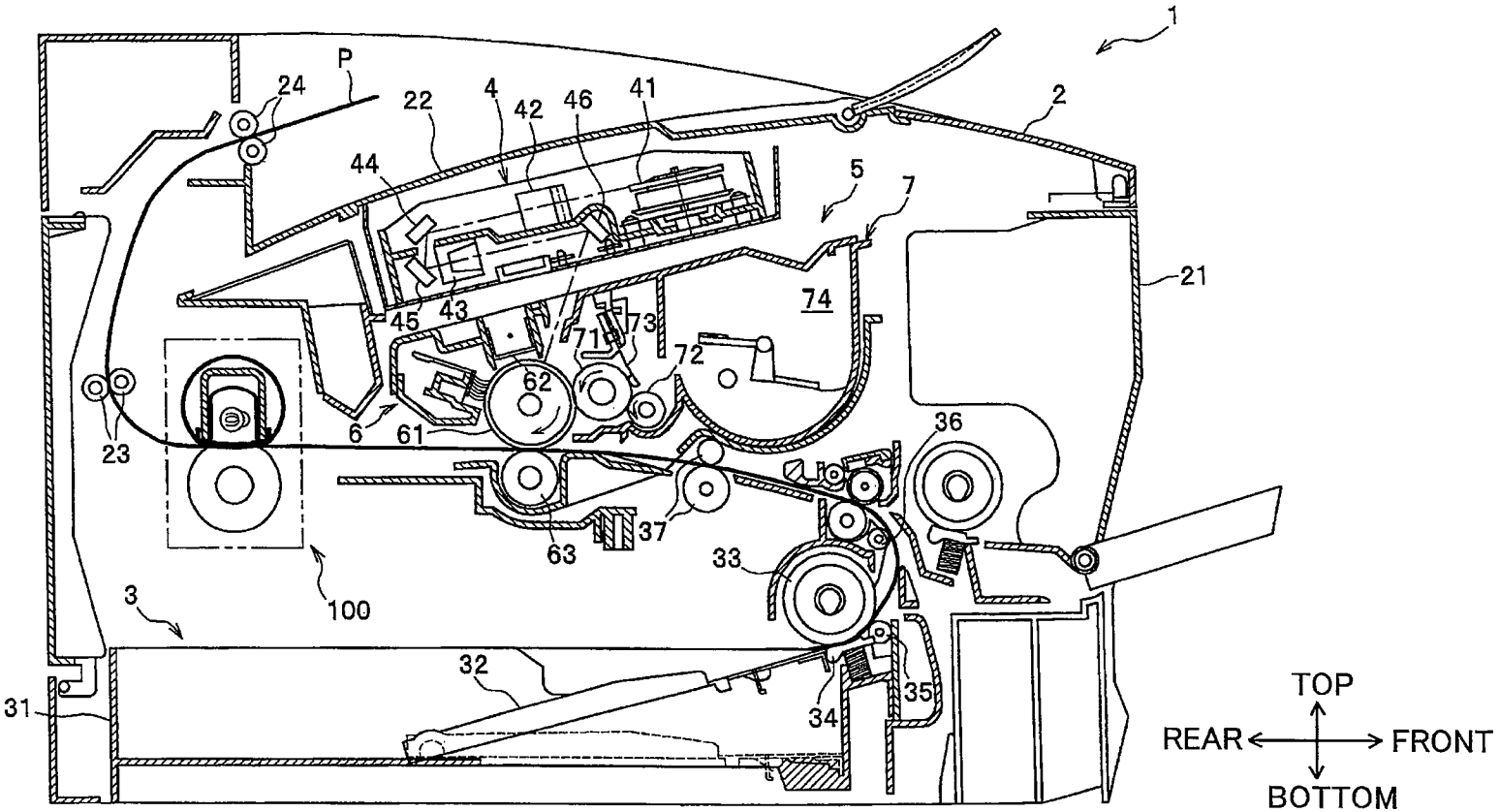
FIG. 1 is a schematic cross-sectional view showing a structure of a laser printer having a fixing device according to one embodiment of the present invention.

Next, a general structure of a laser printer as an image forming device according to one embodiment of the present invention will be described with reference to FIG. 1. The laser printer 1 shown in FIG. 1 is provided with a fixing device 100 according to the embodiment of the present invention. A detailed structure of the fixing device 100 will be described later while referring to FIGS. 2 to 5C.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
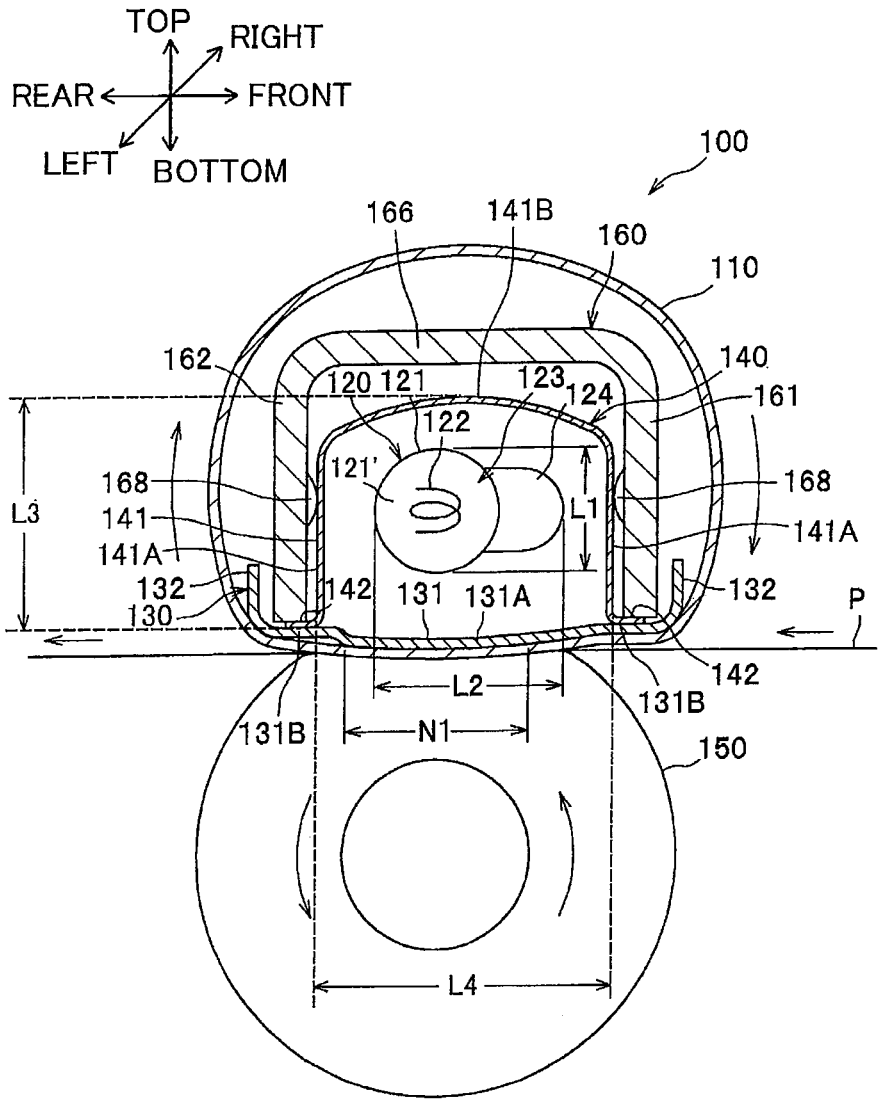
FIG. 2 is a schematic cross-sectional view showing a structure of the fixing device according to the embodiment.

As shown in FIG. 2, the fixing device 100 includes a flexible tubular fusing member such as a tube or film 110, a halogen lamp (halogen heater) 120, a nip plate (nip member) 130, a reflection plate 140, a pressure roller 150 as a backup member, and a stay 160.

In the following description, a frontward/rearward direction will be simply referred to as a sheet feeding direction; a widthwise direction of the sheet P (a lateral or rightward/leftward direction) will be simply referred to as a widthwise direction; and a direction such that the nip plate 130 confronts the halogen lamp 120 (a vertical direction) will be simply referred to as a confronting direction.

The fusing film 110 is of a tubular configuration having heat resistivity and flexibility. Each widthwise end portion of the fusing film 110 is guided by a guide member (not shown) fixed to a casing (not shown) of the fixing device 100 so that the fusing film 110 is circularly movable.

The halogen lamp 120 is a heater to heat the nip plate 130 and the fusing film 110 for heating toner on the sheet P. The halogen lamp 120 is positioned at an internal space of the fusing film 110 and is spaced away from an inner surface of the nip plate 130 by a predetermined distance. The halogen lamp 120 includes a glass tube (heating body) 121, and a filament 122 as a heat source disposed at an internal space of the glass tube 121. Halogen gas 123 is sealed in the glass tube 121.

The glass tube 121 has a glass tube body 121' and a tip portion (projection) 124 protruding radially outwardly from the glass tube body 121'. The tip portion 124 is inevitably formed for sealing the halogen gas 123 in the glass tube 121. The glass tube 121 is oriented such that the tip portion 124 protrudes frontward (upstream of the glass tube body 121' in the sheet feeding direction), so that a combination of the glass tube body 121' and the tip portion 124 defines a vertical cross-sectional length L1 in the confronting direction smaller than a cross-sectional length L2 in the sheet feeding direction.

The nip plate 130 is adapted for receiving pressure from the pressure roller 150 and for transmitting radiant heat from the halogen lamp 120 to the toner on the sheet P through the fusing film 110. To this effect, the nip plate 130 is stationarily positioned such that an inner peripheral surface of the fusing film 110 is moved slidably therewith through grease.

The nip plate 130 has a generally U-shaped cross-section made from a material such as aluminum having a thermal conductivity higher than that of the stay 160 (described later) made from steel. More specifically, for fabricating the nip plate 130, an aluminum plate is bent into U-shape to provide a base portion 131 and upwardly folded portions 132.

The base portion 131 has a center portion 131A in the sheet feeding direction and end portions 131B. The center portion 131A is protruding toward the pressure roller 150, and has an inner surface painted with a black color or provided with a heat absorbing member so as to efficiently absorb radiant heat from the halogen lamp 120. One of the end portions 131B provided at a position frontward of the center portion 131A has a length in the sheet feeding direction greater than remaining one of the end portions 131B provided at a position rearward of the center portion 131A. With this arrangement, preheating to the fusing film 110 described later can be attained.

Figure 3:
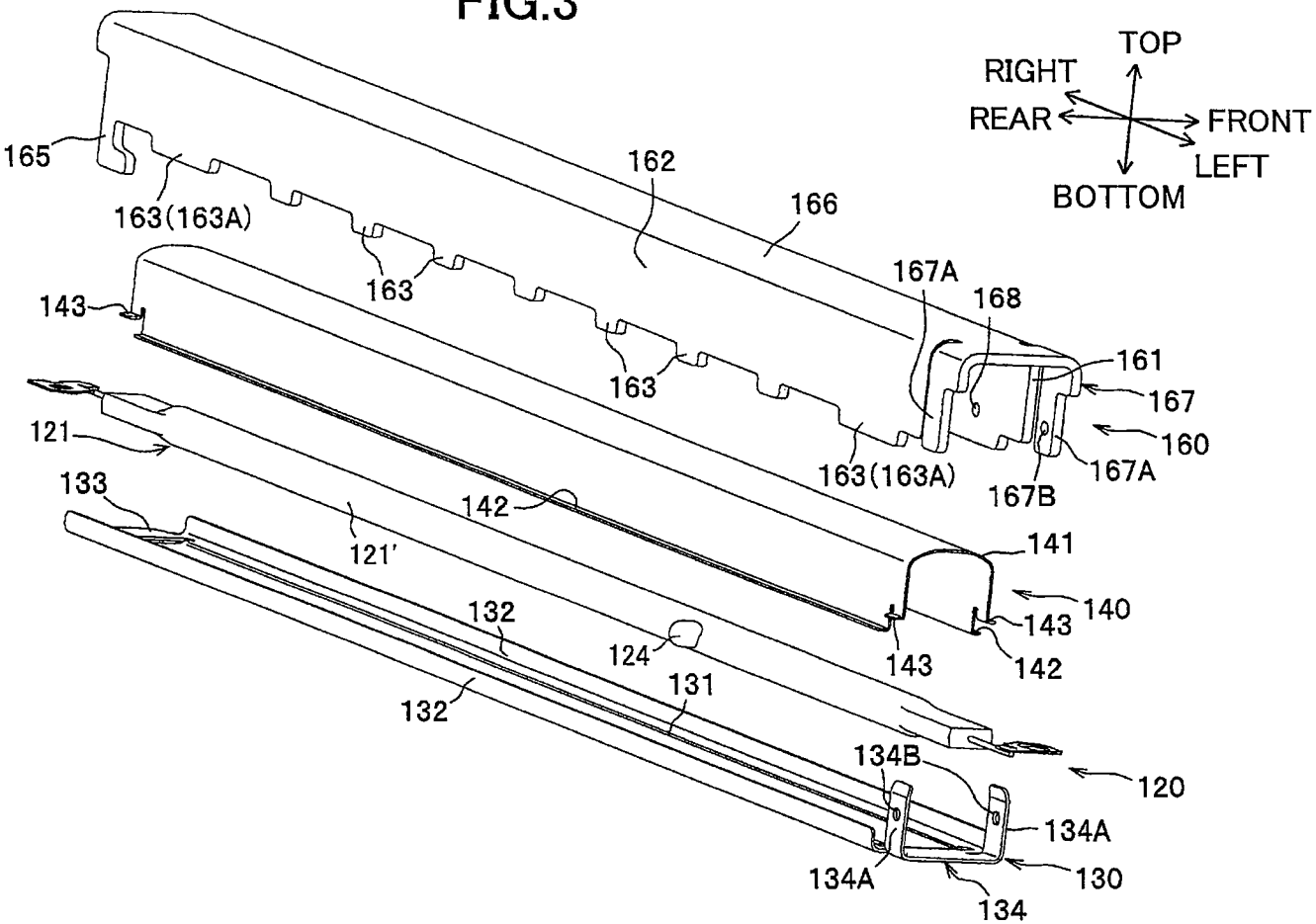
FIG. 3 is an exploded perspective view showing a halogen lamp, a nip plate, a reflection plate, and a stay.

As shown in FIG. 3, the nip plate 130 has a right end portion provided with an insertion portion 133 extending flat, and a left end portion provided with an engagement portion 134. The engagement portion 134 has U-shaped configuration as viewed from a left side including side wall portions 134A extending upward and formed with engagement holes 134B.

The reflection plate 140 is adapted to reflect radiant heat radiating in the frontward/rearward direction and the upper direction from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

Because of the above-described difference in length L1 and L2, a top wall 141B of the reflection plate 140 and a top wall 166 of the stay 160 as well as the nip plate 130 can be positioned as close as possible to the surface of the glass tube body 121'. Thus, a compact halogen lamp 120 in the upward/downward direction can be provided, which leads to a compact fixing device 100 in the upward/downward direction.

Further, the tip portion 124 protrudes horizontally frontward. To this effect, the nip plate 130 has a front elongated portion (front end portion 131B) extending frontward from the nip region N1. The front elongated portion can function as a preheat portion in contact with the inner peripheral surface of the fusing film 110 for preheating a portion of the fusing film 110, the portion being immediately upstream of the nip region N1.

Here, the nip region N1 nips the sheet P between the nip plate 130 (more specifically, the fusing film 110) and the pressure roller 150 to transfer heat of the fusing film to the sheet P. The center of the nip region N1 in the sheet feeding direction is positioned in alignment with the axis of the glass tube body 121' and the axis of the pressure roller 150. Thus, the halogen lamp 120 can efficiently heat the nip region N1. Since the tip portion 124 is provided at a position frontward of the glass tube body 121', the front elongated portion of the nip plate 130 extends frontward from the nip region N1. Hence, preheating to the fusing film 110 can be attained by the front elongated portion, thereby improving image-fixing performance.

The reflection plate 140 is configured into U-shape in cross-section and is made from a material such as aluminum having high reflection ratio regarding infrared ray and far infrared ray. The reflection plate 140 has a U-shaped reflection portion 141 including front and rear side walls 141A, the top portion 141B, and a flange portion 142 extending from each end portion of the reflection portion 141 in the sheet feeding direction. The reflection plate 140 has a vertical cross-sectional length L3 in the confronting direction, that is, a vertical length defined between the top portion 141B and the flange portion 142, and a horizontal cross-sectional length L4 in the sheet feeding direction, that is a horizontal length defined between the front and rear side walls 141A. The vertical cross-sectional length L3 is smaller than the horizontal cross-sectional length L4. A mirror surface finishing is available on the surface of the aluminum reflection plate 140 for specular reflection in order to enhance heat reflection ratio. As shown in FIG. 3, two engagement sections 143 are provided at each widthwise end of the reflection plate 140. Each engagement section 143 is positioned higher than the flange portion 142.

The pressure roller 150 is positioned below the nip plate 130 and nips the fusing film 110 in cooperation with the nip plate 130 to provide a nip region N1 for nipping the sheet P between the pressure roller 150 and the fusing film 110. In other words, the pressure roller 150 presses the nip plate 130 through the fusing film 110 for providing the nip region N1 between the pressure roller 150 and the fusing film 110.

The pressure roller 150 is rotationally driven by a drive motor (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region N1 between the pressure roller 150 and the fusing film 110.

The stay 160 is adapted to support the end portions 131B of the nip plate 130 for maintaining rigidity of the nip plate 130. The stay 160 has a U-shape configuration in conformity with the outer shape of the reflection portion 141 covering the reflection plate 140. For fabricating the stay 160, a highly rigid member such as a steel plate is folded into U-shape to have a top wall 166, a front wall 161 and a rear wall 162. As shown in FIG. 3, each of the front wall 161 and the rear wall 162 has a lower end portion provided with comb-like contact portions 163.

As a result of assembly of the nip plate 130 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in the widthwise direction due to vibration caused by operation of the fixing device 100 can be restrained by the engagement between the engagement sections 143 and the comb-like contact portions 163A.

The front and rear walls 161, 162 have right end portions provided with L shaped engagement legs 165 each extending downward and then leftward. The insertion portion 133 of the nip plate 130 is insertable into a space between the confronting engagement legs 165 and 165. Further, each end portion 131B of the base portion 131 is abuttable on each engagement leg 165 as a result of the insertion.

The top wall 166 has a left end portion provided with a retainer 167 having U-shaped configuration. The retainer 167 has a pair of retaining walls 167A whose inner surfaces are provided with engagement bosses 167B each being engageable with each engagement hole 134B.

As shown in FIGS. 2 and 3, each widthwise end portion of each of the front wall 161 and the rear wall 162 has an inner surface provided with two abutment bosses 168 protruding inward in abutment with front and rear side walls of the reflection plate 140 in the sheet feeding direction. Therefore, displacement of the reflection plate 140 in the sheet feeding direction due to vibration caused by operation of the fixing device 100 can be restrained because of the abutment of the reflection portion 141 with the bosses 168.

Assembling procedure of the reflection plate 140 and the nip plate 130 to the stay 160 will be described. First, the reflection plate 140 is temporarily assembled to the stay 160 by the abutment of the outer surface of the reflection portion 141 on the abutment bosses 168. In this case, the engagement sections 143 are in contact with the widthwise endmost contact portions 163A.

Figure 4:
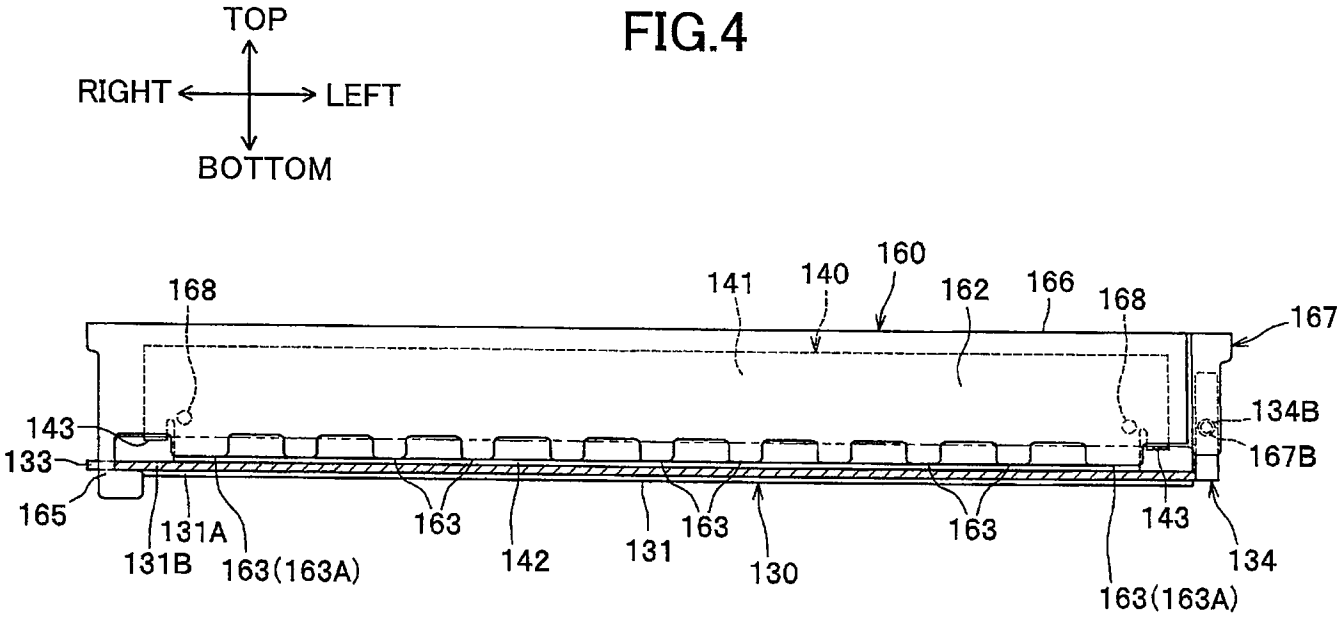
FIG. 4 is a rear view showing an assembled state of the nip plate, the reflection plate and the stay.

Then, as shown in FIG. 4, the insertion portion 133 is inserted between the engagement legs 165 and 165, so that the base portion 131 can be brought into engagement with the engagement legs 165. Thereafter, the engagement bosses 167B are engaged with the engagement holes 134B. By this engagement, each flange portion 142 is sandwiched between the nip plate 130 and the stay 160. Thus, the nip plate 130 and the reflection plate 140 are held to the stay 160.

Vertical displacement of the reflection plate 140 due to vibration caused by operation of the fixing device 100 can be restrained, since the flange portions 142 are held between the nip plate 130 and the stay 160 as shown in FIG. 2. Thus, position of the reflection plate 140 relative to the nip plate 130 can be fixed.

Incidentally, the stay 160 holding the nip plate 130 and the reflection plate 140 and the halogen lamp 120 are held to the guide member (not shown) that guides circular movement of the fusing film 110. The guide member is fixed to the main casing (not shown) of the fixing device 100. Thus, the fusing film 110, the halogen lamp 120, the nip plate 130, the reflection plate 140, and the stay 160 are held to the main casing of the fixing device 100.

Figure 5A:
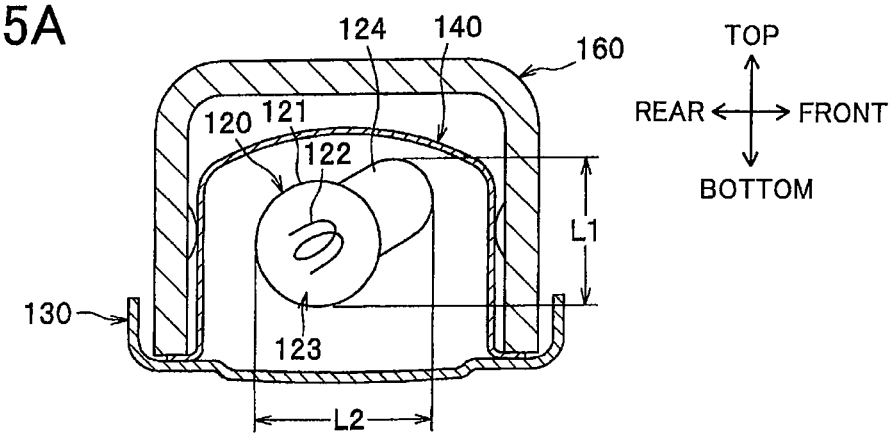
FIG. 5A is a schematic cross-sectional view of the fixing device in which a tip portion of the halogen lamp protrudes in a direction obliquely upward and frontward.
Figure 5B:
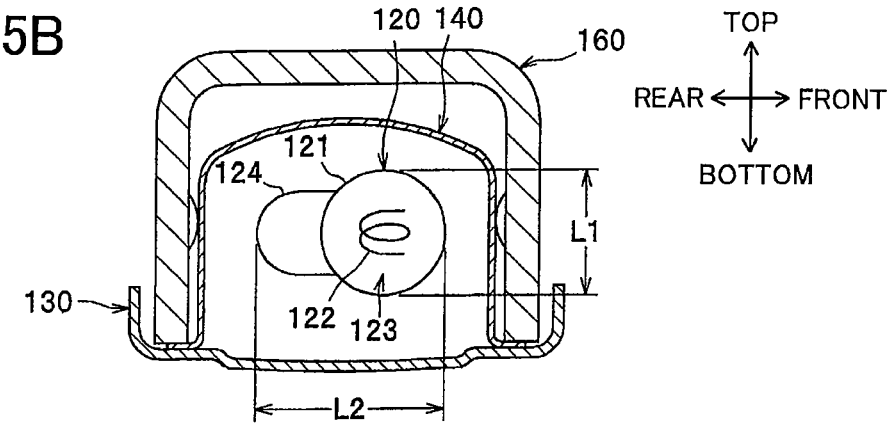
FIG. 5B is a schematic cross-sectional view of the fixing device in which the tip portion of the halogen lamp protrudes horizontally rearward.

Various modifications are conceivable. For example, in the above-described embodiment, the tip portion 124 protrudes horizontally frontward or is positioned upstream of the glass tube body 121' in the sheet feeding direction. However, protruding direction of the tip portion 124 is not limited to the depicted embodiment. For example, the tip portion 124 can protrude in a direction obliquely upward and frontward as shown in FIG. 5A, or horizontally rearward as shown in FIG. 5B, i.e., is positioned downstream of the glass tube body 121' in the sheet feeding direction, as long as the relationship L1<L2 is satisfied. In FIG. 5A, the tip portion has a portion not overlapping with the glass tube body as viewed in the confronting direction. The tip portion also has a portion not overlapping with the glass tube body as viewed in the sheet feeding direction.

Figure 5C:
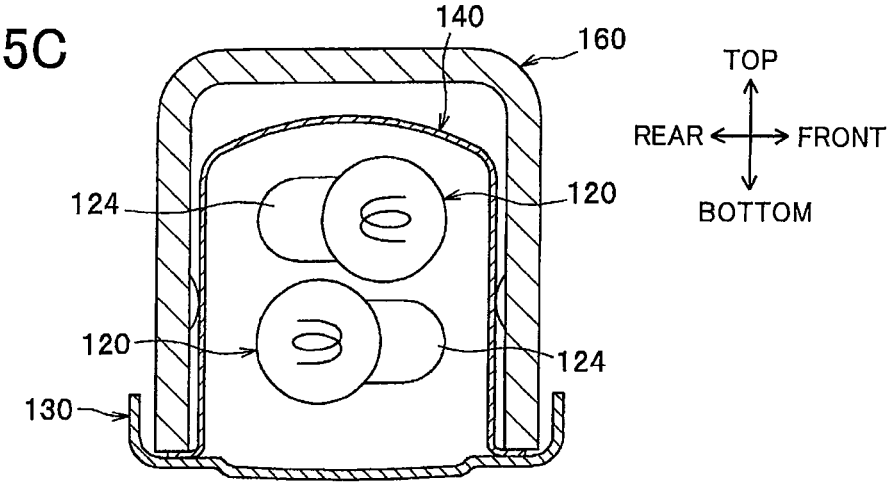
FIG. 5C is a schematic cross-sectional view of the fixing device in which two halogen lamps are juxtaposed with each other in a horizontal direction.

Further, as shown in FIG. 5C, two halogen lamps 120 can be juxtaposed with each other in the vertical direction (confronting direction) so as to accelerate heating to the nip plate 130. In this case, a tip portion 124 of one of the halogen lamps 120 protrudes rearward or is positioned downstream of the glass tube body 121' in the sheet feeding direction, and another tip portion 124 of remaining one of the halogen lamps 120 protrudes frontward or is positioned upstream of the glass tube body 121' in the sheet feeding direction. With this arrangement, the halogen lamps 120 can be vertically closer to each other in comparison with a case where two halogen lamps 120 are juxtaposed such that a glass tube body 121' of one of the halogen lamps 120 is vertically aligned with another glass tube body 121' of remaining one of the halogen lamps 120. Hence, heating performance can be improved without enlarging the fixing device 100.

The fusing film 110 can be formed of resin or metal. Alternatively, the fusing film 110 can be provided with an outer rubber layer.

In the depicted embodiment, the stay 160 can be dispensed with. Further, an infrared ray heater or a carbon heater is available instead of the halogen lamp 120.

In the depicted embodiment, the pressure roller 150 is employed as a backup member. However, a belt like pressure member is also available. Further, in the depicted embodiment, the nip region N1 is provided by the pressure contact of the backup member (pressure roller 150) against the nip plate 130. However, the nip region N1 can also be provided by a pressure contact of the nip plate 130 against the backup member.

Further, the sheet P can be an OHP sheet instead of plain paper and a postcard.

Further, in the depicted embodiment, the image forming device is the monochromatic laser printer. However, a color laser printer, an LED printer, a copying machine, and a multifunction device are also available.

While the invention has been described in detail with reference to the embodiment thereof, it would be apparent to those skilled in the art that various changes and modifications may be made therein without departing from the spirit of the invention.

What is claimed is:

1. A fixing device comprising:

a tubular flexible fusing member having an inner peripheral surface defining an internal space;

a nip plate extending in the internal space of the tubular flexible fusing member, the inner peripheral surface of the tubular flexible fusing member being configured to slide with the nip plate in a sliding direction;

a heater extending in the internal space, the heater comprising:

a glass tube including a glass tube body and a tip portion protruding radially outwardly from the glass tube body, a heat source, and a gas sealed in the glass tube;

a backup member, the backup member and the nip plate being configured to nip the tubular flexible fusing member therebetween; and a stay disposed opposite to the backup member relative to the nip plate, the stay having:

a first end face facing the nip plate and supporting the nip plate, the nip plate being disposed between the first end face and the backup member, and a second end face spaced apart from the first end face in the sliding direction, the second end face facing the nip plate and supporting the nip plate, the nip plate being disposed between the second end face and the backup member, wherein the glass tube body defines an imaginary plane which is tangential to a closest generatrix of the glass tube body closer to the nip plate than remaining generatrices of the glass tube body to the nip plate, the imaginary plane and the nip plate defining a gap therebetween, the tip portion being outside of the gap, and wherein the nip plate has a generally U-shape to provide a base portion extending along the heater and folded portions folded toward the heater, the base portion including a center portion and flat end portions, the center portion extending along the heater and disposed between the flat end portions, the center portion protruding in a direction away from the heater.

2. The fixing device as claimed in claim 1, wherein the heater is a halogen heater.

3. The fixing device as claimed in claim 1, wherein the fusing member comprises a film.

4. The fixing device as claimed in claim 1, wherein the heater faces the nip plate in a first direction, wherein the glass tube body defines an axial line, and wherein the tip portion has a portion not overlapping with the glass tube body when viewed in a second direction that is perpendicular to both of the first direction and the axial line of the glass tube body.

5. The fixing device as claimed in claim 1, wherein the tubular flexible fusing member is configured to be in sliding contact with the nip plate in a sliding direction, and wherein the tip portion protrudes upstream from the glass tube body in the sliding direction.

6. The fixing device as claimed in claim 1, wherein the tubular flexible fusing member is configured to be in sliding contact with the nip plate in a sliding direction, and wherein the tip portion protrudes downstream of the glass tube body in the sliding direction.

7. The fixing device as claimed in claim 1, wherein the tubular flexible fusing member is configured to be in sliding contact with the nip plate in a sliding direction, and wherein the tip portion is positioned upstream of the glass tube body in the sliding direction.

8. The fixing device as claimed in claim 1, wherein the tubular flexible fusing member is configured to be in sliding contact with the nip plate in a sliding direction, and wherein the tip portion is positioned downstream of the glass tube body in the sliding direction.

9. The fixing device as claimed in claim 1, further comprising a metal frame, wherein the metal frame and the nip plate surround the heater.

10. The fixing device as claimed in claim 9, wherein the metal frame is a reflection member.

11. The fixing device as claimed in claim 1, wherein the stay has a substantially U-shape.

12. The fixing device as claimed in claim 1, wherein a thickness of the stay is greater than a thickness of the nip plate.

13. The fixing device as claimed in claim 1, further comprising a reflector extending in the internal space, wherein the stay has a portion opposite to the nip plate relative to the reflector.

14. The fixing device as claimed in claim 1, further comprising a reflector extending in the internal space, wherein the first end face of the stay and the nip plate pinch a first portion of the reflector.

15. The fixing device as claimed in claim 14, wherein the second end face of the stay and the nip plate pinch a second portion of the reflector.

16. A fixing device comprising:

an endless belt having an inner peripheral surface defining an internal space;

a nip member extending in the internal space of the endless belt, the inner peripheral surface of the endless belt being configured to slide with the nip member in a sliding direction;

a heater extending in the internal space, the heater comprising a glass tube including:

a glass tube body having a tubular shape, and a tip portion protruding outwardly from the glass tube body;

a backup member, the backup member and the nip member being configured to nip the endless belt therebetween; and a stay disposed opposite to the backup member relative to the nip member, the stay having:

a first end face facing the nip member and supporting the nip member, the nip member being disposed between the first end face and the backup member, and a second end face spaced apart from the first end face in the sliding direction, the second end face facing the nip member and supporting the nip member, the nip member being disposed between the second end face and the backup member, wherein the glass tube body defines an imaginary plane which is tangential to a closest generatrix of the glass tube body closer to the nip member than remaining generatrices of the glass tube body to the nip member, the imaginary plane and the nip member defining a gap therebetween, the tip portion being outside of the gap, and wherein the nip member has a generally U-shape to provide a base portion extending along the heater and folded portions folded toward the heater, the base portion including a center portion and flat end portions, the center portion extending along the heater and disposed between the flat end portions, the center portion protruding in a direction away from the heater.

17. The fixing device as claimed in claim 16, wherein the heater faces the nip member in a first direction, wherein the glass tube body defines an axial line, and wherein the tip portion has a portion not overlapping with the glass tube when viewed in a second direction that is perpendicular to both of the first direction and the axial line of the glass tube body.

18. The fixing device as claimed in claim 16, wherein the endless belt is configured to be in sliding contact with the nip member in a sliding direction, and wherein the tip portion protrudes downstream from the glass tube body in the sliding direction.

19. The fixing device as claimed in claim 16, wherein the endless belt is configured to be in sliding contact with the nip member in a sliding direction, and wherein the tip portion protrudes upstream of the glass tube in the sliding direction.

20. The fixing device as claimed in claim 16, wherein the nip member includes a plate.

21. The fixing device as claimed in claim 16, further comprising a frame, wherein the frame and the nip member surround the heater.

22. The fixing device as claimed in claim 16, wherein the stay has a substantially U-shape.

23. The fixing device as claimed in claim 16, wherein a thickness of the stay is greater than a thickness of the nip member.

24. The fixing device as claimed in claim 16, further comprising a reflector extending in the internal space, wherein the stay has a portion opposite to the nip member relative to the reflector.

25. The fixing device as claimed in claim 16, further comprising a reflector extending in the internal space, wherein the first end face of the stay and the nip member pinch a first portion of the reflector.

26. The fixing device as claimed in claim 25, wherein the second end face of the stay and the nip member pinch a second portion of the reflector.

27. A fixing device comprising:

an endless belt having an inner peripheral surface defining an internal space;

a nip member extending in the internal space of the endless belt, the inner peripheral surface of the endless belt being configured to slide with the nip member in a sliding direction;

a heater extending in the internal space, the heater comprising a glass tube, the glass tube including:

a glass tube body having a tubular shape and defining an axial line of the glass tube body, and a tip portion protruding radially outwardly from the glass tube body;

a backup member, the backup member and the nip member being configured to nip the endless belt therebetween, the backup member defining a nip region between the endless belt and the backup member; and a stay disposed opposite to the backup member relative to the nip member, the stay having:

a first end face facing the nip member and supporting the nip member, the nip member being disposed between the first end face and the backup member, and a second end face spaced apart from the first end face in the sliding direction, the second end face facing the nip member and supporting the nip member, the nip member being disposed between the second end face and the backup member, wherein the tip portion is away from an imaginary line that is perpendicular to the axial line of the glass tube body and passes through both of the axial line of the glass tube body and the nip region, and wherein the nip member has a generally U-shape to provide a base portion extending along the heater and folded portions folded toward the heater, the base portion including a center portion and flat end portions, the center portion extending along the heater and disposed between the flat end portions, the center portion protruding in a direction away from the heater.

28. The fixing device as claimed in claim 27, wherein the heater faces the nip member in a first direction, and wherein the tip portion has a portion not overlapping with the glass tube body when viewed in a second direction that is perpendicular to both of the first direction and the axial line of the glass tube body.

29. The fixing device as claimed in claim 27, wherein the endless belt is configured to be in sliding contact with the nip member in a sliding direction, and wherein the tip portion protrudes downstream from the glass tube body in the sliding direction.

30. The fixing device as claimed in claim 27, wherein the endless belt is configured to be in sliding contact with the nip member in a sliding direction, and wherein the tip portion protrudes upstream from the glass tube body in the sliding direction.

31. The fixing device as claimed in claim 27, wherein the heater is a halogen heater.

32. The fixing device as claimed in claim 27, wherein the nip member includes a plate.

33. The fixing device as claimed in claim 27, wherein the stay has a substantially U-shape.

34. The fixing device as claimed in claim 27, wherein a thickness of the stay is greater than a thickness of the nip member.

35. The fixing device as claimed in claim 27, further comprising a reflector extending in the internal space, wherein the stay has a portion opposite to the nip member relative to the reflector.

36. The fixing device as claimed in claim 27, further comprising a reflector extending in the internal space, wherein the first end face of the stay and the nip member pinch a first portion of the reflector.

37. The fixing device as claimed in claim 36, wherein the second end face of the stay and the nip member pinch a second portion of the reflector.

38. A fixing device comprising:

a tubular member having an inner peripheral surface defining an internal space;

a nip member extending in the internal space of the tubular member, the inner peripheral surface of the tubular member being configured to slide with the nip member in a sliding direction;

a heater extending in the internal space, the heater comprising a glass tube including:

a glass tube body having a tubular shape and defining an axial line of the glass tube body, and a tip portion protruding radially outwardly;

a backup member, the backup member and the nip member being configured to nip the tubular member therebetween, the backup member defining a nip region between the tubular member and the backup member; and a stay disposed opposite to the backup member relative to the nip member, the stay having:

a first end face facing the nip member and supporting the nip member, the nip member being disposed between the first end face and the backup member, and a second end face spaced apart from the first end face in the sliding direction, the second end face facing the nip member and supporting the nip member, the nip member being disposed between the second end face and the backup member, wherein the tip portion is away from an imaginary arbitrary line that is perpendicular to the axial line of the glass tube body and that passes through both of the axial line of the glass tube body and the nip region, and wherein the nip member has a generally U-shape to provide a base portion extending along the heater and folded portions folded toward the heater, the base portion including a center portion and flat end portions, the center portion extending along the heater and disposed between the flat end portions, the center portion protruding in a direction away from the heater.

39. The fixing device as claimed in claim 38, wherein the heater faces the nip member in a first direction, and wherein the tip portion has a portion not overlapping with the glass tube body when viewed in a second direction that is perpendicular to both of the first direction and the axial line of the glass tube.

40. The fixing device as claimed in claim 38, wherein the tubular member is configured to be in sliding contact with the nip member in a sliding direction, and wherein the tip portion protrudes downstream from the glass tube body in the sliding direction.

41. The fixing device as claimed in claim 38, wherein the tubular member is configured to be in sliding contact with the nip member in a sliding direction, and wherein the tip portion protrudes upstream from the glass tube body in the sliding direction.

42. The fixing device as claimed in claim 38, wherein the heater is a halogen heater.

43. The fixing device as claimed in claim 38, wherein the nip member includes a plate.

44. The fixing device as claimed in claim 38, further comprising a frame, wherein the frame and the nip member surround the heater.

45. The fixing device as claimed in claim 44, wherein the frame is a reflection member.

46. The fixing device as claimed in claim 44, wherein the frame is a stay that supports the nip member.

47. The fixing device as claimed in claim 38, wherein the backup member is a roller.

48. The fixing device as claimed in claim 38, wherein the stay has a substantially U-shape.

49. The fixing device as claimed in claim 38, wherein a thickness of the stay is greater than a thickness of the nip member.

50. The fixing device as claimed in claim 38, further comprising a reflector extending in the internal space, wherein the stay has a portion opposite to the nip member relative to the reflector.

51. The fixing device as claimed in claim 38, further comprising a reflector extending in the internal space, wherein the first end face of the stay and the nip member pinch a first portion of the reflector.

52. The fixing device as claimed in claim 51, wherein the second end face of the stay and the nip member pinch a second portion of the reflector.

* * * * *